US005692688A

United States Patent [19]

Waitman et al.

[11] Patent Number: 5,692,688

[45] Date of Patent: Dec. 2, 1997

[54] COMMINUTING SCREEN FOR HAMMERMILLS

[75] Inventors: Ted D. Waitman, Waverly; Heath Lynn Hartwig, Waterloo, both of Iowa

[73] Assignee: California Pellet Mill Company, Nashua, N.H.

[21] Appl. No.: 691,908

[22] Filed: Aug. 1, 1996

[51] Int. Cl.[6] ..... B02C 13/04; B02C 13/284

[52] U.S. Cl. ..... 241/73; 241/88; 241/89.2; 241/189.1

[58] Field of Search ..... 241/73, 74, 88, 241/88.2, 88.3, 89.2, 189.1

[56] References Cited

U.S. PATENT DOCUMENTS

| | | | |
|---|---|---|---|
| 1,035,313 | 8/1912 | Buchanan . | |
| 2,012,416 | 8/1935 | Bartels | 83/11 |
| 2,996,260 | 8/1961 | Carder | 241/73 |
| 3,090,568 | 5/1963 | Wetmore | 241/73 |
| 3,549,093 | 12/1970 | Pallmann | 241/49 |
| 4,231,529 | 11/1980 | Peck et al. | 241/189 R |
| 4,998,676 | 3/1991 | Graziano | 241/55 |
| 5,192,029 | 3/1993 | Harris | 241/27 |
| 5,364,038 | 11/1994 | Prew | 241/189.1 |
| 5,503,338 | 4/1996 | Thom, Jr. | 241/73 |

FOREIGN PATENT DOCUMENTS

| | | | |
|---|---|---|---|
| 754537 | 3/1967 | Canada | 241/74 |
| 627853 | 10/1978 | U.S.S.R. | 241/74 |
| 1329820 | 8/1987 | U.S.S.R. | 241/74 |

*Primary Examiner*—John M. Husar
*Attorney, Agent, or Firm*—Nixon & Vanderhye

[57] ABSTRACT

A hammermill having a polygon profile screen which provides for improved hammer impact and crushing efficiency. Particles in the working zone of the hammermill tend to be accelerated in the direction of hammer rotation. This acceleration lessens the speed differential between the hammer and the particle, which lessens the impact force and crushing efficiency. The polygonal screen inhibits this acceleration of particles in the working zone, due to flow interruptions caused by its irregular shape, thus increasing the particle-to-hammer speed differential and crushing efficiency.

6 Claims, 5 Drawing Sheets

COMMINUTING SCREEN FOR HAMMERMILLS

BACKGROUND OF THE INVENTION

This invention relates generally to hammermills and more particularly to a screen for use in a hammermill.

Hammermills used for grinding or comminuting materials commonly consist of a large housing having a feed material inlet at the top, a grinding chamber below the feed material inlet, and a ground material outlet below the grinding chamber. The grinding chamber is defined by an apertured screen extending downwardly from one edge of the feed material inlet and curving about to form a partly cylindrical surface before extending back upwardly to the other edge of the inlet. The resulting cross-sectional shape is roughly a teardrop formed by a circular lower portion bounded by two tangent straight lines converging toward the edges of the feed material inlet. The apertured screen provides the wall of the grinding chamber and surrounds a rotor mounted coaxially in the cylindrical portion of the grinding chamber. On the rotor, a number of hammers are pivotably mounted to be free to swing when the rotor is rotated.

During rotation, the outboard ends of the hammers pass closely along the surface of the apertured screen, impacting upon the feed materials and, thereby, comminuting the materials until the particles are fine enough to pass through the apertured screen to the particle outlet of the housing of the hammermill.

During grinding of a material in a hammermill, the particles of the material, after the first impact of the hammers, very quickly attain the velocity of the hammers tangentially to the screen surface. This is partly due to the impact and partly due to the fanning action of the rotor on the air in the grinding chamber. Of course, the low angle of contact of the particles with the screen prevents passage of even properly sized particles through the apertures so that the particles travel along the screen surface at approximately the same velocity as do the hammer tips. This results in a very low number of low-energy impacts and an unsatisfactory production rate.

The foregoing illustrates limitations known to exist in present hammermills. Thus, it is apparent that it would be advantageous to provide an alternative directed to overcoming one or more of the limitations set forth above. Accordingly, a suitable alternative is provided including features more fully disclosed hereinafter. Other types of hammermills include full circle hammermills with side inlets, half-circle hammermills, and vertical hammermills with top inlets.

SUMMARY OF THE INVENTION

In one aspect of the present invention, this is accomplished by providing a hammermill comprising: a rotor mounted on a driven shaft; a plurality of free-swinging hammers attached to the rotor; a polygonal apertured screen mounted about the rotor, the polygonal apertured screen being comprised of a plurality of straight apertured screen segments.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
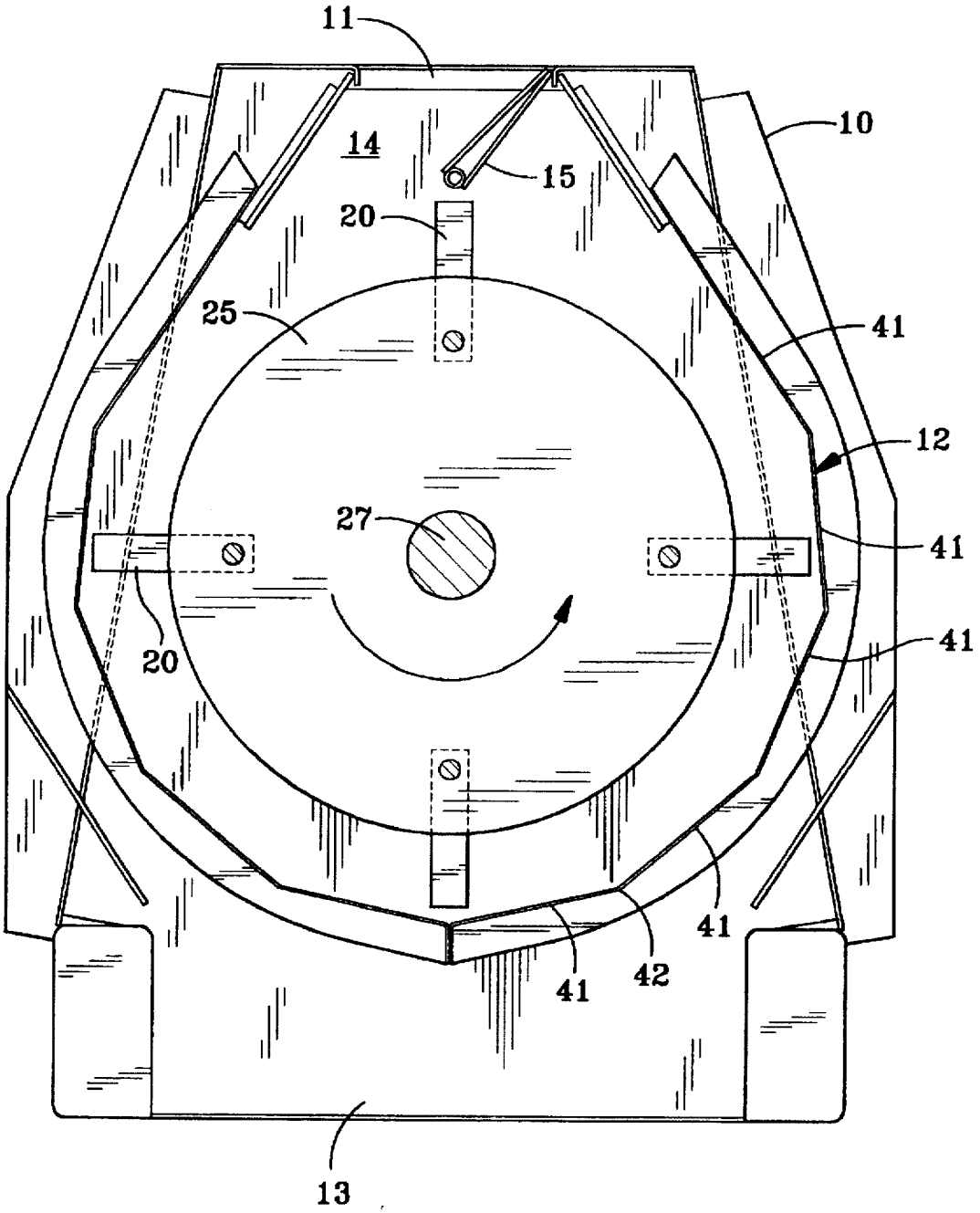
FIG. 1 is a cross-section of a hammermill with a polygonal apertured screen.

Referring to FIG. 1, a sectional view of a hammermill shows a housing 10 with a feed material inlet 11 at the top, a ground particle discharge 13 at the bottom, a screen 12 having a polygonal shaped cross-section and being suspended from both edges of the material inlet 11 so as to receive all feed material coming through the inlet 11. A rotor 25 is rotatably mounted on a driven shaft 27 and has a plurality of hammers 20 which are free to swing when the rotor 25 is rotated. An anti-reflux gate 15 prevents feed material from being driven upwardly through inlet 11 by impact with hammers 20. A grinding chamber 14 within the hammermill is defined by the space between the screen 12 and the rotor 25. During operation, feed material enters through the material inlet 11 and falls into the grinding chamber 14 where it is repeatedly struck by the rapidly swinging hammers 20 until it has been ground sufficiently fine to pass through the apertures in screen 12, after which the feed material passes through discharge 13 and is removed from the hammermill.

Figure 2:
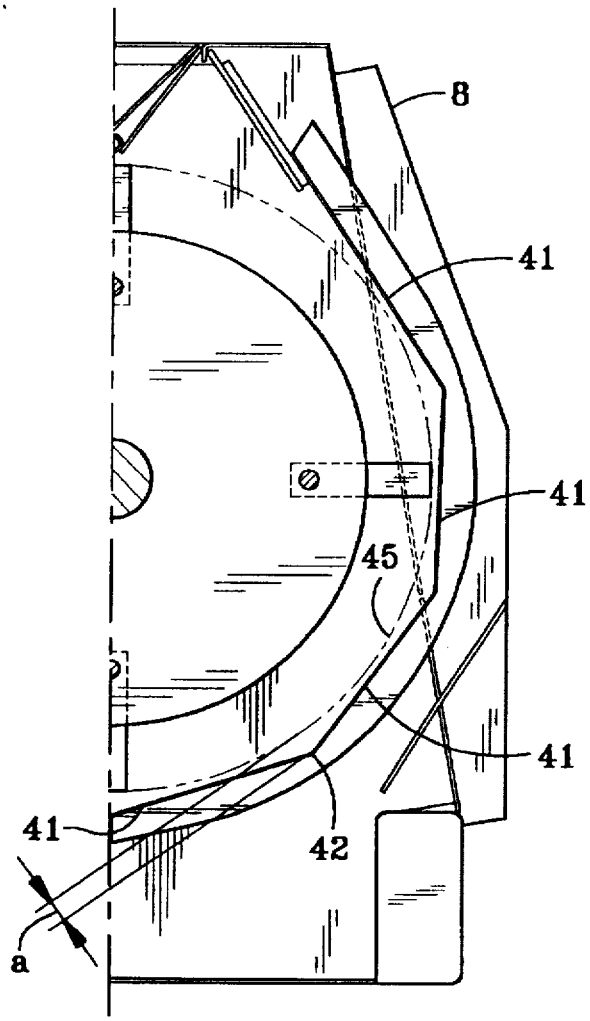
FIG. 2 is a cross-section of one-half of a hamermill with a second embodiment of a polygonal apertured screen.
Figure 3:
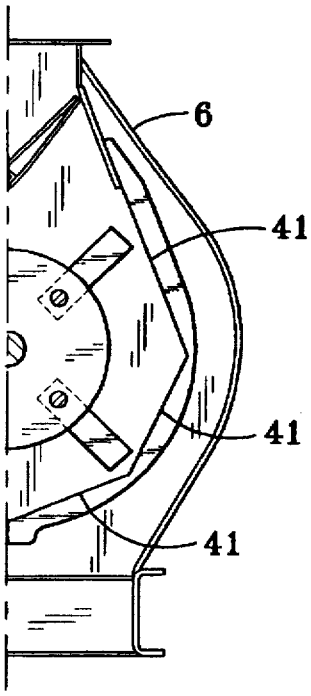
FIG. 3 is a cross-section of one-half of a hammermill with a third embodiment of a polygonal apertured screen.

The screen 12 is formed of a plurality of straight apertured segments 41 joined at their edges 42 (or corners). FIGS. 1 through 3 illustrate three common sizes of hammermills. A hammermill (FIG. 1) having a fifty-four inch diameter rotor preferably uses ten straight segments 41 to form the screen 12. Hammermills with rotor diameters of forty-four inches and twenty-two inches will use eight and six straight segments 41, respectively (FIGS. 2 and 3). Preferably, the corners 42 of the screen 12 are between ¾ inch and 2¼ inches (illustrated at "a" in FIG. 2) from a circle 45 circumscribed by the hammer tips when the rotor 25 is rotated. An optimal spacing of the corners 42 from the circle 45 is between 1 inch and 1½ inch. From a review of FIG. 2, it will be seen that each segment forms a continuous, substantially uninterrupted surface with a surface of a next-adjacent segment and has a mid-point parallel to a tangent of a circle circumscribed by the tips of the free-swinging hammers as the hammers rotate about the axis of rotation of rotor 25.

The polygon profile screen provides for improved hammer impact and crushing efficiency. Particles in the working zone of the hammermill tend to be accelerated in the direction of hammer rotation. This acceleration lessens the speed differential between the hammer 20 and the particle, which lessens the impact force and crushing efficiency. The polygonal screen 12 inhibits this acceleration of particles in the working zone, due to flow interruptions caused by its irregular shape, thus increasing the particle-to-hammer speed differential and crushing efficiency.

In one test of a forty-four inch diameter rotor hammermill, the capacity of the hammermill increased by about 15% from 22.8 tons per hour using a conventional tear-dropped shaped screen with 9/64 inch holes to 26.3 tons per hour using an octagonal screen with 9/64 inch holes. The conventional tear-dropped screen yielded an average micron size of 380 and a log normal standard deviation of 2.979. The mill capacity at full load was 22.8 tons per hour. The octagonal screen yielded a micron size of 401 and a log normal standard deviations of 2.846. The mill capacity at full load with the octagonal screen was 26.3 tons per hour.

Figure 4:
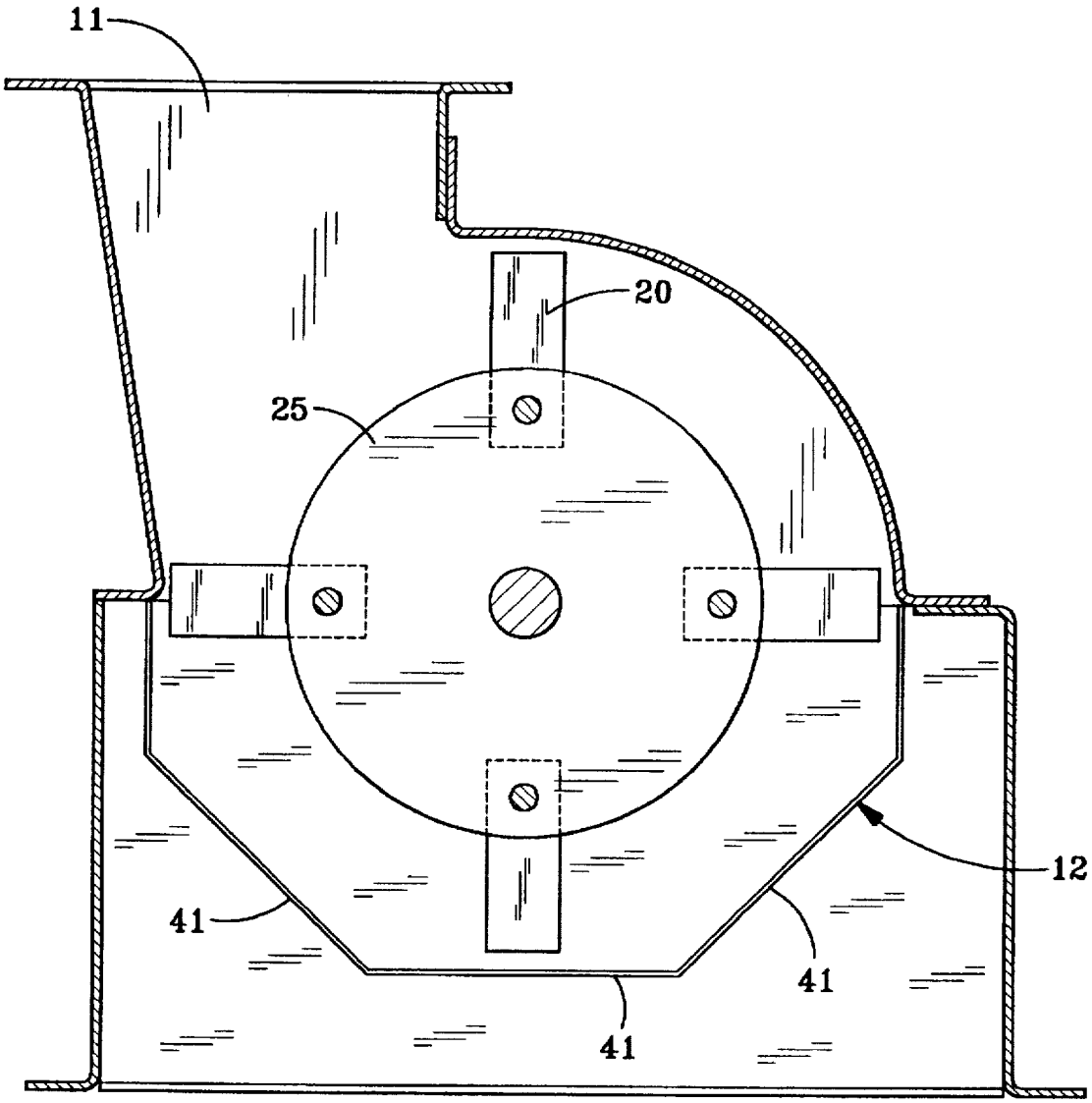
FIG. 4 is a cross-section of a half-circle hammermill with a polygonal apertured screen.
Figure 5A:
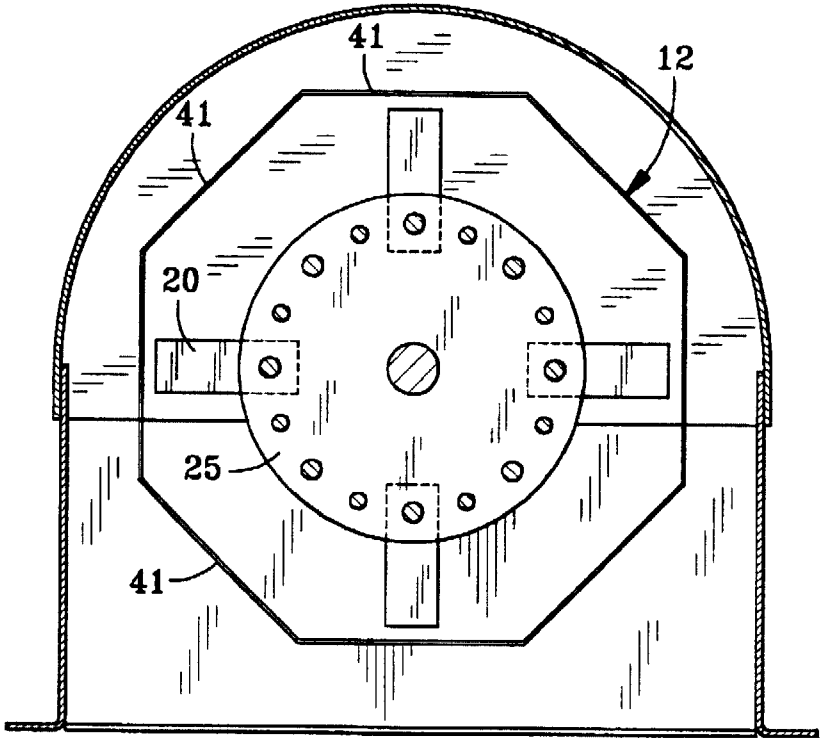
FIGS. 5 and 5A are cross-sectional side and front views of a full-circle side inlet hammermill with a polygonal apertured screen.
Figure 5:
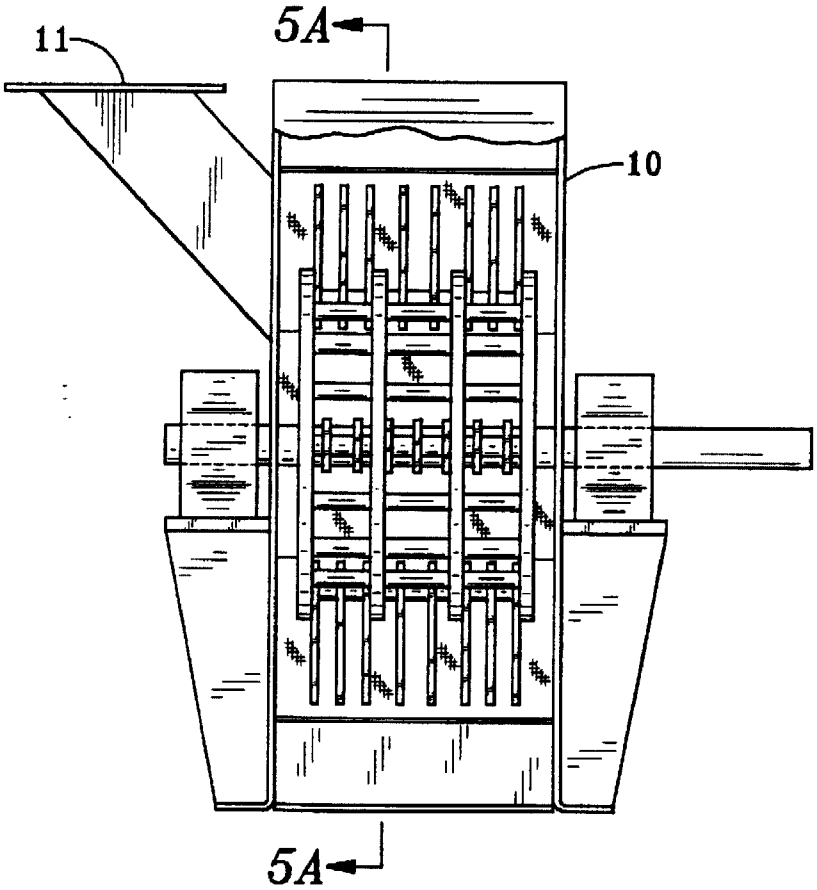
Figure 6A:
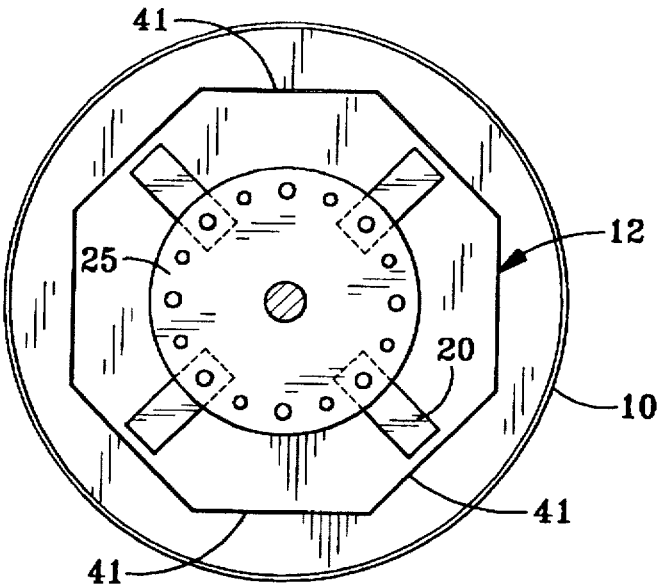
FIGS. 6 and 6A are cross-sectional side and top views of a vertical side inlet hammermill with a polygonal apertured screen.
Figure 6:
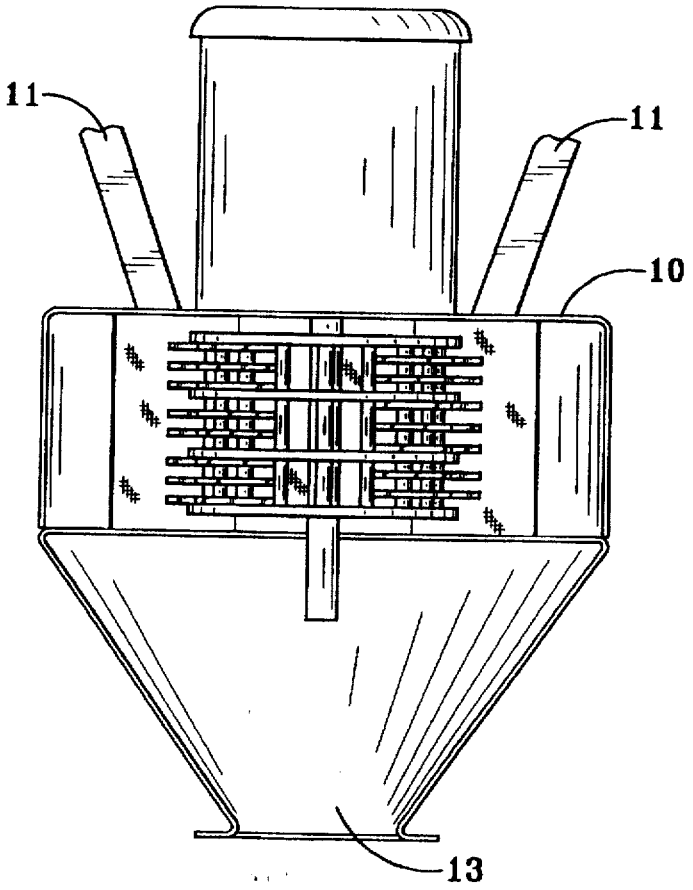

FIG. 4 shows a half-circle hammermill where the rotor 25 rotates about a horizontal axis. The screen 12 consists of a plurality of straight apertured segments 41 positioned about the lower half of the rotor 25. FIGS. 5 and 5A show a full circle hammermill having the feed material inlet 11 located in the side of the housing 10. The screen 12 consists of a plurality of straight apertured screen segments 41 completely surrounding the rotor 25. FIGS. 6 and 6A show a full circle vertical hammermill with one or more inlets 11 in the top of the housing 10. The screen 12 consists of a plurality of straight apertured screen segments 41 completely surrounding the rotor 25.

Having described the invention, what is claimed is:

1. A hammermill comprising:

a rotor mounted on a driven shaft for rotation about an axis;

a plurality of free-swinging hammers attached to the rotor;

a polygonal apertured screen mounted about the rotor, the polygonal apertured screen being comprised of a plurality of straight apertured screen segments, each segment forming a continuous, substantially uninterrupted surface with a surface of a next-adjacent segment and having a mid-point parallel to a tangent of a circle circumscribed by tips of said free-swinging hammers as the rotor rotates about said axis.

2. The hammermill according to claim 1 wherein corners, defined by a line where one straight apertured screen segment is joined to an adjacent straight apertured screen segment, are a predefined distance from a circle circumscribed by tips of the hammers when the rotor is rotated, the predefined distance being between about ¾ inch and about 2¼ inches.

3. The hammermill according to claim 2 wherein the predefined distance is between about 1 inch and about 1½ inches.

4. The hammermill according to claim 1 wherein the number of straight apertured screen segments is between 4 and 12.

5. A hammermill comprising:

a rotor mounted on a driven shaft for rotation about an axis;

a plurality of free-swinging hammers attached to the rotor;

a polygonal apertured screen mounted about the rotor, the polygonal apertured screen being comprised of a plurality of straight apertured screen segments, each segment forming a continuous, substantially uninterrupted surface with a surface of a next-adjacent segment and having a mid-point parallel to a tangent of a circle circumscribed by tips of said free-swinging hammers as the rotor rotates about said axis.

6. A hammermill comprising:

a rotor mounted on a driven shaft for rotation about an axis;

a plurality of free-swinging hammers attached to the rotor;

a polygonal apertured screen mounted about the rotor, the polygonal apertured screen being comprised of a plurality of straight apertured screen segments, the number of straight apertured screen segments between 4 and 12, each segment forming a continuous, substantially uninterrupted surface with a surface of a next-adjacent segment and having a mid-point parallel to a tangent of a circle circumscribed by tips of said free-swinging hammers as the rotor rotates about said axis.

* * * * *